US005336012A

United States Patent [19]

Newville

[11] Patent Number: 5,336,012

[45] Date of Patent: Aug. 9, 1994

[54] FLOW-THROUGH WASHING AND SCRUBBING BRUSH HANDLE

[76] Inventor: Duane H. Newville, P.O. Box 40008, St. Petersburg, Fla. 33743

[21] Appl. No.: 2,652

[22] Filed: Jan. 11, 1993

[51] Int. Cl.[5] ..... A46B 11/06; A47L 13/22

[52] U.S. Cl. ..... 401/289; 401/281; 401/203; 239/281; 403/109; 16/115

[58] Field of Search ..... 401/289, 275, 280, 281, 401/203, 204, 140, 138, 272; 16/115; 403/109, 83, 84; 239/281, DIG. 13, 532, 530, 203; 294/19.1

[56] References Cited

U.S. PATENT DOCUMENTS

| | | | |
|---|---|---|---|
| 352,009 | 11/1888 | Seery | 401/289 |
| 1,003,008 | 9/1911 | Pugh | 401/204 |
| 1,577,225 | 3/1926 | Granger | 239/281 X |
| 1,598,742 | 9/1926 | Parker | 401/289 X |
| 4,466,152 | 8/1984 | Moss et al. | 16/115 X |
| 4,508,467 | 4/1985 | Choffin | 294/19.1 |

FOREIGN PATENT DOCUMENTS

| | | | |
|---|---|---|---|
| 3330488 | 3/1985 | Fed. Rep. of Germany | 401/289 |
| 648191 | 3/1985 | Switzerland | 401/289 |

*Primary Examiner*—Danton D. DeMille

*Attorney, Agent, or Firm*—Joseph C. Mason, Jr.; Ronald E. Smith

[57] ABSTRACT

An improved flow-through washing and scrubbing brush handle for interconnection at one end to a source of pressurized water such as a garden hose and connectable at the other end to a flow-through type scrub brush or the like. The device may include structure for varying water flow therethrough for delivery into the scrub brush and further includes a telescoping structure which releasably secures a selected overall length between its sliding inner and outer tubes. Unique sealing arrangements also prevent water leakage anywhere along the device, including from between inner and outer tubes.

2 Claims, 1 Drawing Sheet

FIG. 1
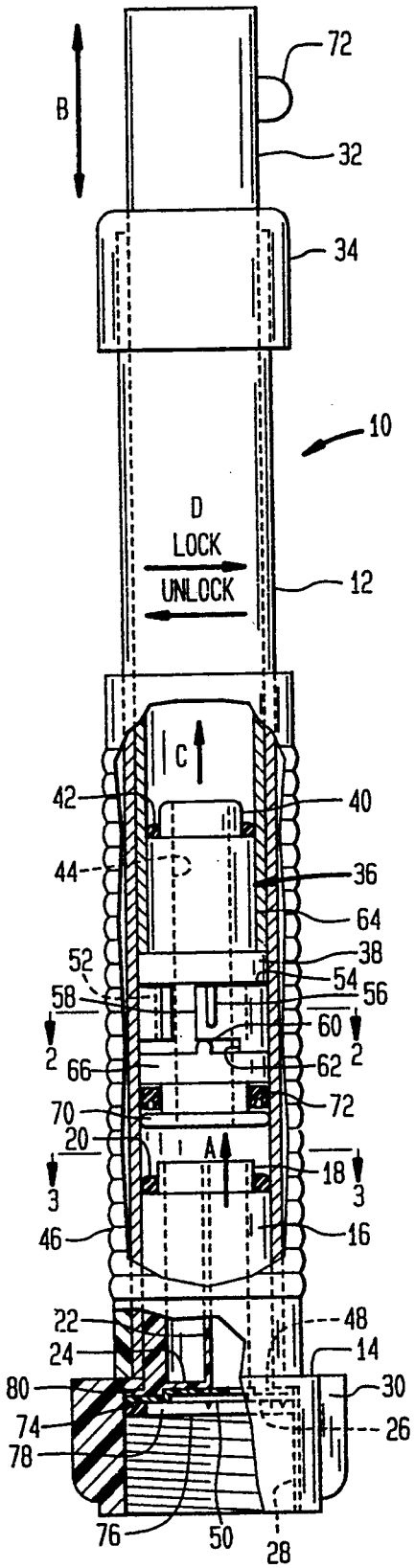
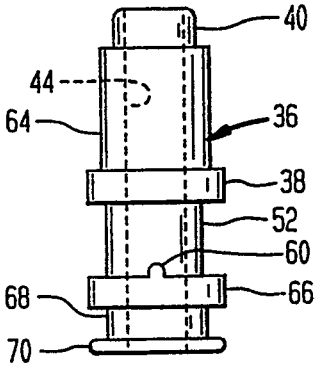
FIG. 4
FIG. 2
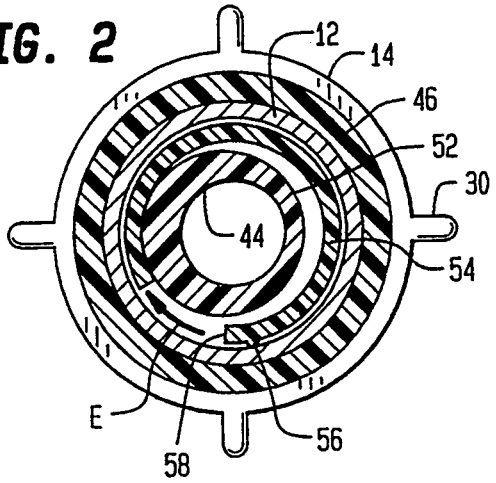
FIG. 3
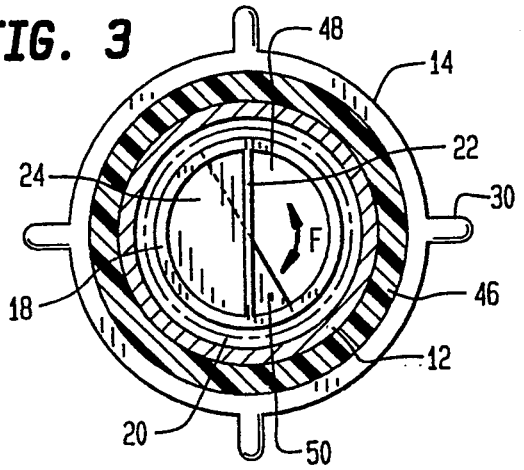

FLOW-THROUGH WASHING AND SCRUBBING BRUSH HANDLE

BACKGROUND OF THE INVENTION

Scope of Invention

This invention relates generally to cleaning and washing devices, and more particularly to a telescopic flow-through washing and scrubbing brush handle.

Prior Art

The use of flow-through handles or wands for washing and scrubbing automobiles, campers and other vehicles, boats, aluminum siding and windows and the like is well known. Typically, these devices include a coupling or connector at one end which is connectable to a source of pressurized water such as a garden hose and connectable at the other end thereof to a flow-through type scrubbing brush which will transfer water through the brush structure and bristles onto the surface to be cleaned. The benefits of water being continuously applied at the cleaning surface so as to both accelerate the cleaning process and rinse debris away as well as to reduce the abrasion to that working surface is also well known.

Beyond the basic concept of this above prior art device are imposed many desirable design features, some of which have not been met in prior art. One such feature is a telescoping handle wherein the overall length thereof may be adjusted and secured at any desired length. Conventional rotationally actuated cam locking arrangements for this purpose are well known.

Another desirable design feature is the ability to vary the water flow through the device, including the ability to quickly interrupt water flow to prevent water waste. Here again various shut-off devices for garden hose arrangements are also well known.

Perhaps the most annoying feature of present prior art devices is the water leakage which occurs during use both at the garden hose coupling end of the device and at the mid portion thereof where the outer tube overlaps the inner tube to facilitate the telescoping feature. Although the user may anticipate some water contact during a car washing procedure, nonetheless the presently existing degree of water leakage through present devices is so excessive as to impose a serious limitation on the overall usefulness of these devices.

The present invention provides a flow-through washing and scrubbing handle which affords all of the above design features while eliminating virtually all water leakage along the entire length of the device so that all pressurized water which exists the garden hose into the device is transmitted into and through the flow-through brush head itself without leakage.

BRIEF SUMMARY OF THE INVENTION

This invention is directed to an improved flow-through washing and scrubbing brush handle for interconnection at one end to a source of pressurized water such as a garden hose and connectable at the other end to a flow-through type scrub brush or the like. The device may include structure for varying water flow therethrough for delivery into the scrub brush and further includes a telescoping structure which releasably secures a selected overall length between its sliding inner and outer tubes. Unique sealing arrangements also prevent water leakage anywhere along the device, including from between inner and outer tubes.

It is therefore an object of this invention to provide a telescopic flow-through washing and scrubbing brush handle for delivering water from a pressurized water source such as a garden hose into a flow-through scrubbing brush head or the like.

It is yet another object of this invention to provide a leakage free telescopic flowthrough washing and scrubbing brush handle.

It is yet another object of this invention to provide a leakage free telescopic flowthrough washing and scrubbing brush handle which will vary or shut off the flow of water therethrough also without leakage.

In accordance with these and other objects which will become apparent hereinafter, the instant invention will now be described with reference to the accompanying drawings.

BRIEF DESCRIPTION OF THE DRAWINGS

FIG. 1 is a side elevation broken section view of the invention.

FIG. 2 is a section view in the direction of arrows 2—2 in FIG. 1.

FIG. 3 is a section view in the direction of arrows 3—3 in FIG. 1.

FIG. 4 is a side elevation view of the integral twist lock body shown in FIG. 1.

DETAILED DESCRIPTION OF THE INVENTION

Referring now to the drawings, the invention is shown generally at numeral 10 in FIG. 1 and includes an elongated drawn aluminum outer tube 12 slidably engagable over a drawn aluminum inner tube 32. Although extruded rolled tubing stock is acceptable, it is preferred to use drawn aluminum as the dimensional tolerances are more closely held and the strength properties of the aluminum are significantly increased. The outer surface of the inner and outer tubes 32 and 12 are also anodized for additional appearance and corrosion protection.

An end cap 34, formed of molded resilient plastic and fitted over one end of the outer tube 12, serves as a travel stop and sleeve guide to prevent the inner tube 32 from separating from the outer tube 12 and to also provide a bearing surface between the two tubes 12 and 32. The distal end of the inner tube 32 includes a depressible locking pin 72 which is engagable into a flow-through type scrubbing and cleaning brush (not shown) in a well known manner.

The lower end of the outer tube 12 includes a tubular gripping handle 46 secured therearound formed of molded resilient plastic material for convenient gripping and also includes a rotatable coupling 14. This coupling 14 includes an internal longitudinal thread 28 which is matably engagable onto the threaded end fitting of a garden hose (not shown). Coupling 14 also includes integral molded radially extending tightening flanges 30 so as to facilitate a more secure connection onto the end of the garden hose.

A plastic molded water control valve 16 is also fitted into this lower end of the outer tube 12 having an enlarged lower flange 80 molded into one end so as to engage against the bottom of the internal threaded portion 28 of coupling 14. A longitudinal partition 22 is molded lengthwise through the otherwise hollow interior of control valve 16 and one half of this hollow control valve interior is closed off at its lower end by an end partition 24. This control valve 16 is rigidly secured into the end of the outer tube 14 by staking or otherwise point deforming the outer tube 12 so as to mechanically engage into the control valve 16.

Positioned against and beneath the flange 80 is a rotatable flow control disc 50 which includes a flow aperture 48 formed therethrough. This flow aperture 48 is sized to mate and align with the open portion of the control valve 16 so that water will flow upward through the control valve 16 in the direction of arrow A. However, when the disc 50 is rotated back and forth in the direction of arrow F so as to either partially or fully misaligned with the open half of the control valve 16 so as to partially or fully be in alignment with end partition 24, the water flow in the direction of arrow A is either diminished or stopped altogether.

A conventional rubber sealing grommet 76 having central hole 78 therethrough is fitted against control disc 50 in a well-known manner. However, to insure that by rotation of coupling 14, the disc 50 will truly follow this coupling rotation, prongs 74 integrally molded and downwardly extending from disc 50, are also provided for mechanical penetrating engagement into the rubber grommet 78.

To insure that water flowing in the direction of arrow A under pressure does not backflow between the control valve 16 and outer tube 12, a rubber O-ring 20 is fitted around a reduced diameter end groove 18 of the control valve 16.

A twist lock body is shown generally at 36 and structurally facilitates both the locking engagement between the inner and outer tubes 32 and 12, respectively, and also prevents any water leakage between the inner and outer tubes 32 and 12. This twist-lock body 36 is integrally molded of plastic and includes at its upper end as seen in FIG. 1 a reduced diameter end groove 40 sized to receive a rubber O-ring 42 for sealing engagement against the inner wall of the inner tube 32. Cylindrical main body portion 64 is mechanically secured within the inner tube 32 by staking as previously described.

The twist-lock body 36 also includes a longitudinal passageway 44 therethrough so that water flowing in the direction of arrow A will flow therethrough in the direction of arrow C into the interior of the inner tube 32 for discharge into a conventional flow-through brush connected at the distal end of the inner tube 32 (not shown) as previously described. Shoulder 38 serves as a mechanical stop against the lower end of end cap 34.

A sealing groove is formed adjacent the lower shoulder end 70 of the twist-lock body 36 so as to receive a one-way packing seal 72 such as provided by Parker Seals of Salt Lake City, Utah, Series 8500. This seal 72 is provided so as to sealably prevent water flowing into the interior of the outer tube 12 in the direction of arrow A from escaping or leaking therearound. Absent this seal 72, the pressurized water would leak out from between the inner and outer tubes 32 and 12, respectively.

The twist-lock body also includes an eccentric or off-center cam surface 52 as best seen in FIG. 2, loosely mounted around which is a plastic locking collar 54. The locking collar 54 includes bump or protrusion 56 adjacent its longitudinal end surface 58 so that, when the locking collar is rotated in the direction of arrow E, a wedging effect between the interior surface of the outer tube 12 and eccentric surface 52 is effected. By this arrangement, the secure, yet releasable locking engagement between the inner and the outer tube 32 and 12, respectively at any preselected arranged telescopic length in the direction of arrow B is effected. Stop surface 62 formed into the lower end of the locking collar 54 serves to prevent overrotation in the direction of arrow E against protrusion 60 of the twistlock body 36.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An improved flow-through washing and scrubbing brush handle comprising:

an elongated hollow outer tube having a coupling structured for connecting a first end of said outer tube to a pressurized water supply;

an elongated rigid hollow inner tube mounted for slidable rotational and longitudinal movement within said outer tube, a first end of said inner tube extendable beyond a second end of said outer tube and connectable to a flow-through type brush head;

an elongated twist-lock body having a central longitudinal water passage therethrough, a first portion of said twist-lock body connected within a second end of said inner tube positioned within said outer tube;

said twist-lock body having a first sealing ring around the end of said first portion thereof for preventing water passing into said inner tube through said water passage from passing out of said inner tube second end;

a second sealing ring positioned transversely around an end of a second portion of said twist-lock body extending into said outer tube beyond said inner tube second end, said second sealing ring structured for preventing pressurized water entering said outer tube first end from passing between said inner and outer tubes;

a locking collar loosely positioned transversely around an eccentric cam segment of said twist-lock body second portion;

said locking collar having a radially extending protrusion which lockably engages against an interior wall surface of said outer tube to releasably secure said inner and outer tubes from relative longitudinal movement when said inner tube and twist-lock body are rotated relative to said outer tube.

2. An improved flow-through washing and scrubbing brush handle as set forth in claim 1, further comprising:

means connected to said coupling and positioned within said outer tube first end for adjusting the volume and shutting the flow of water through said outer tube.

* * * * *